United States Patent [19]

Sokolovsky

[11] Patent Number: 4,646,619

[45] Date of Patent: Mar. 3, 1987

[54] SINGULATING APPARATUS FOR A SEMIAUTOMATIC FIREARM

[76] Inventor: Paul J. Sokolovsky, 641 Torrington Dr., Sunnyvale, Calif. 94087

[21] Appl. No.: 676,509

[22] Filed: Nov. 29, 1984

[51] Int. Cl.[4] ..... F41C 5/00

[52] U.S. Cl. ..... 89/145; 42/69.02

[58] Field of Search ..... 42/69 A; 89/139, 144, 89/145, 146, 141, 142

[56] References Cited

U.S. PATENT DOCUMENTS

| | | | |
|---|---|---|---|
| 1,786,536 | 12/1930 | Holek | 42/69 A |
| 2,781,697 | 2/1957 | Kimball | 89/144 |
| 4,203,348 | 5/1980 | Sokolovsky | 89/148 |

*Primary Examiner*—Harold D. Whitehead

*Attorney, Agent, or Firm*—Fliesler, Dubb, Meyer & Lovejoy

[57] ABSTRACT

A singulating apparatus for a semiautomatic handgun is described comprising a spring member which extends from a sear in a cantilevered fashion for engagement by a sear actuating member when the sear actuating member is in a cocked position. When the sear actuating member is moved from its cocked position to a firing position by a pulling of a trigger member, the spring member is disengaged from the sear actuating member, significantly reducing the force necessary to discharge the firearm. The spring constant of the spring member is chosen to hold the sear in its cocked position after releasing a striker to discharge the firearm so as to prevent unintentional automatic operation. The sear is balanced and pivotally mounted in the firearm at its center of balance so as to prevent unintentional discharge of the firearm in the event that the firearm is dropped or struck by a sharp blow.

12 Claims, 13 Drawing Figures

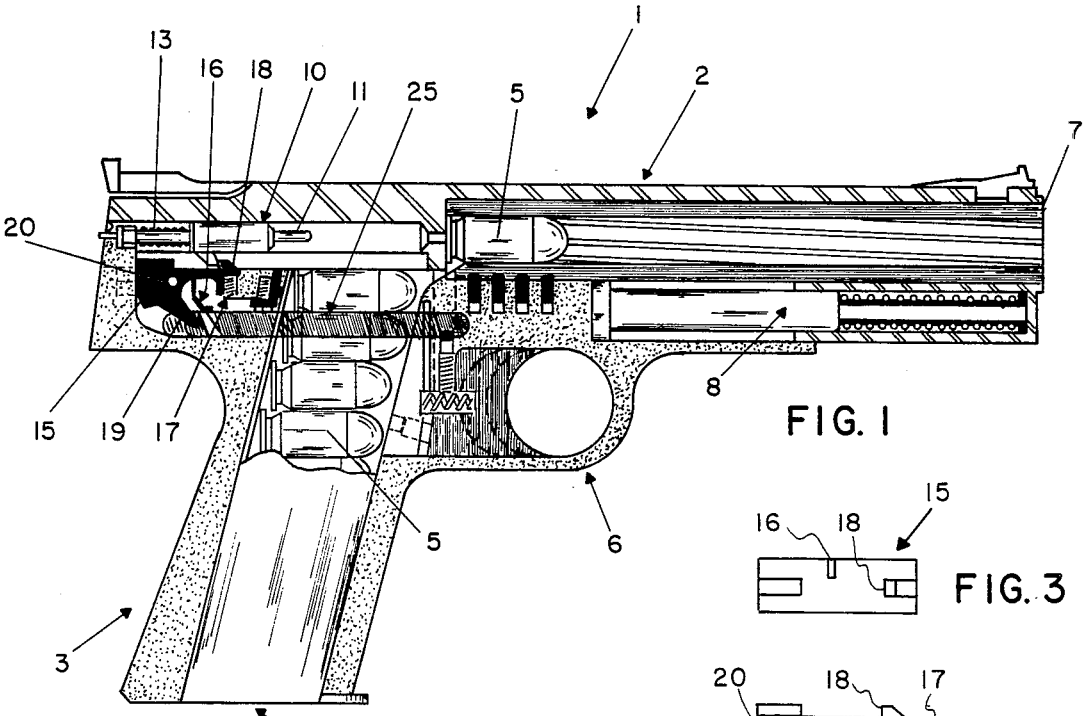
FIG. 1
FIG. 3
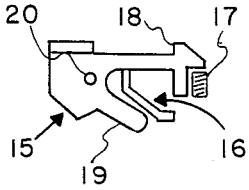
FIG. 2
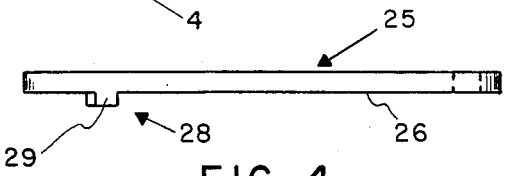
FIG. 4
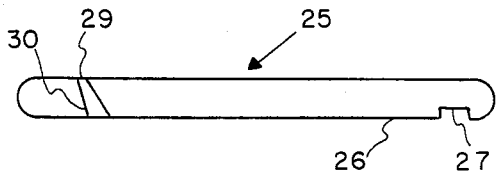
FIG. 5
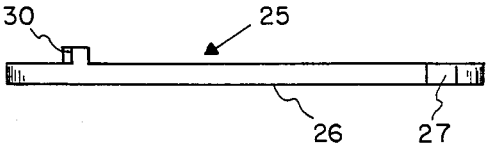
FIG. 6
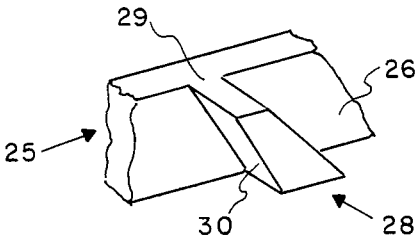
FIG. 7

SINGULATING APPARATUS FOR A SEMIAUTOMATIC FIREARM

BACKGROUND OF THE INVENTION

1. Field of the Invention

The present invention relates to firearms in general and to a singulating apparatus for a semiautomatic handgun in particular.

2. Description of the Prior Art

In semiautomatic handguns, such as the 0.45 shown and described in applicant's U.S. Pat. No. 4,203,348, there is provided a movable member called a slide, a striker, a striker spring, a sear, a sear actuating member and a trigger.

In operation, with the hand gun cocked, as the trigger is pulled the sear actuating member is moved, moving the sear. When the sear is moved it releases the striker which is moved by the striker spring to contact and discharge a bullet from the barrel. After the sear releases the striker, it is returned to its initial or predischarge position by one or more springs to re-engage the striker.

When the bullet is discharged from the barrel, the slide recoils. As the slide recoils it engages the striker carrying the striker rearwardly against the force of the striker spring. After reaching its point of maximum recoil, the slide returns to its initial or predischarge position and the striker is moved into position to be engaged by the sear.

In practice, however, it is possible in prior known handguns for the sear to fail to engage the striker after one or more recoils, causing the handgun to repeatedly discharge a bullet therefrom and thereby unintentionally function as an automatic weapon. The reason for this occurring is possibly due to one or more factors including the weight and balance of the sear, the strength and elasticity of the sear springs and the speed of the striker.

Another problem found to exist in a handgun of the type described above is that it is subject to unintentionally discharging when dropped or struck with a sufficient force. This problem is also believed to be associated with the weight and balance of the sear and the strength and elasticity of the sear springs.

SUMMARY OF THE INVENTION

In view of the foregoing, a principal object of the present invention is a singulating apparatus for preventing the automatic firing of a semiautomatic firearm.

In accordance with the above object there is provided in the firearm a trigger, a slide, a striker, a sear, a spring member attached to the sear in a cantilever fashion and a sear actuating member for moving the sear and releasably engaging the spring member.

In operation, the sear and the sear actuating member are movable between a cocked position and a firing position. When the sear actuating member is in its cocked position, the sear actuating member engages the free end of the spring member causing the sear to be held in its cocked position with a force corresponding to the spring constant of the spring member. The spring constant of the spring member is chosen to insure that the striker is engaged by the sear after each discharge of the firearm to thereby prevent unintentional automatic discharging of the firearm.

As the sear actuating member is moved by the trigger toward its firing position, the spring member is disengaged therefrom allowing the sear to be moved and release the striker with a minimum of force. When the striker is released, it moves forward to strike a bullet in the slide. When the bullet is struck, it discharges, causing the slide to recoil. As the slide recoils, the trigger is disengaged from the sear actuating member allowing the sear and sear actuating member to return to their cocked or predischarge position.

Another object of the present invention is a firearm which will not unintentionally discharge when dropped or struck by a sharp blow.

In accordance with the latter object there is provided in a firearm a sear having a center of balance. The sear is movably mounted in the firearm for pivotal movement about its center of balance so that a dropping of the firearm or a sharp blow to the firearm will have no effect on sear movement.

BRIEF DESCRIPTION OF THE DRAWING

The above and other objects, features and advantages of the present invention will become apparent from the following detailed description of the accompanying drawing in which:

FIG. 1 is a cutaway side elevation view of a semiautomatic firearm according to the present invention;

FIG. 2 is a side elevation view of a sear according to the present invention;

FIG. 3 is a top plan view of FIG. 2;

FIG. 4 is a top plan view of a sear actuating member according to the present invention;

FIG. 5 is a side elevation view of FIG. 4;

FIG. 6 is a bottom plan view of FIG. 5;

FIG. 7 is a partial perspective view of the sear actuating member of FIGS. 4–6;

DETAILED DESCRIPTION OF THE DRAWING

Figure 8:
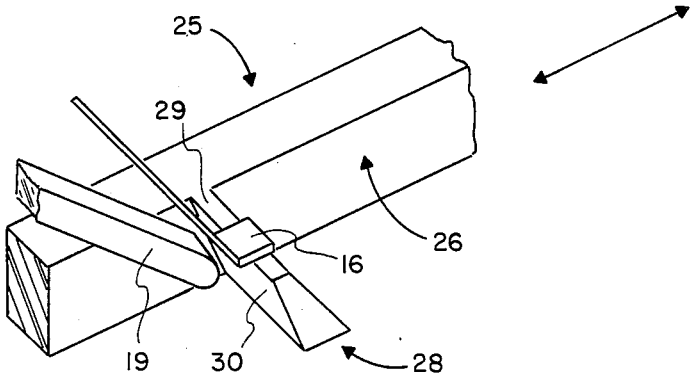
FIG. 8 is a partial perspective view of the sear and sear actuating member of FIGS. 2–7.

Referring to FIGS. 1–8, there is provided in accordance with the present invention a semiautomatic handgun designated generally as 1. The handgun 1 is representative of a 0.45 caliber handgun. In the handgun 1 there is provided a movable slide assembly designated generally as 2, a handle 3 having a space therein for receiving a clip 4 containing a plurality of bullets 5, a trigger assembly designated generally as 6 and a barrel 7 located in the slide 2.

Below the barrel 7 there is provided in a cavity therefor a slide decelerator assembly designated generally as 8. The construction and operation of the assembly 8, forming no part of the present invention, is described in detail in applicant's U.S. Pat. No. 4,388,855.

In a cavity provided therefor in the slide 2, there is provided a striker assembly designated generally as 10. The striker assembly 10, sometimes hereinafter referred to simply as the striker, comprises a firing pin 11 mounted on one end of a main body member 12, a spring 13 and a tooth-like member 14 which depends downwardly from the body member 12.

Below the striker assembly 10 there is pivotally mounted a sear assembly designated generally as 15. In the sear assembly 15 there is provided a primary sear spring 16, a secondary sear spring 17, a ratchet member 18 and an arm 19 which depends downwardly from the assembly 15. As thus described, the assembly 15 comprises a center of balance and is pivotally mounted in the firearm 1 by means of a pin 20 at its center of balance.

Below and to the right of the sear assembly 15 there is provided a linkage comprising a sear actuating member designated generally as 25. In the member 25 there is provided an elongated body 26. At one end of the body 26 there is provided in the undersurface, at one end thereof, a linkage trigger notch 27. At the opposite end thereof, there is provided a spring 31. Located inwardly from the opposite end thereof and extending perpendicularly to the longitudinal axis thereof, there is provided a protrusion designated generally as 28. On the protrusion 28 there is provided a sear spring engaging surface 29 and a sear arm engaging surface 30. The surface 29 comprises a planar surface of relatively narrow dimensions on the top of the member 28. The sear arm engaging surface 30 extends in a plane which extends perpendicular and is inclined to the longitudinal axis of the body 26.

Figure 11:
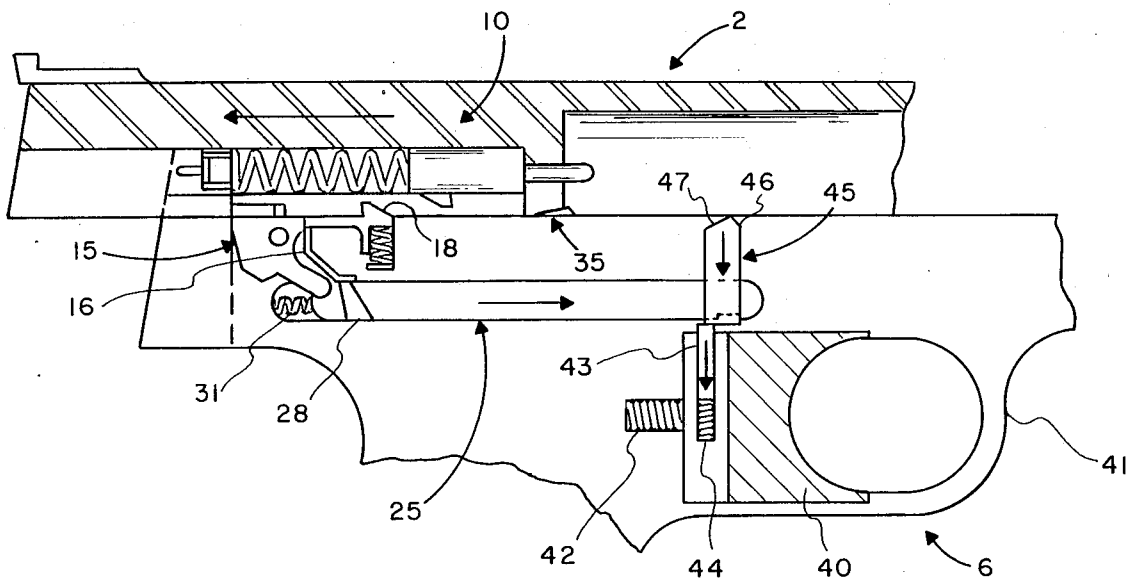

In a bottom surface of the slide 2, as shown more clearly in FIG. 11, there is provided a beveled notch 35.

In the trigger assembly 6, also as shown more clearly in FIG. 11, there is provided a trigger member 40 which is movably mounted in a trigger housing 41. At the rear of the trigger member 40 there is provided a trigger spring 42 and in a cavity provided therefor, a movable pin 43 and pin biasing spring 44. Above the pin 43 and in sliding contact therewith there is provided a slide actuated pin 45. The upper end of the pin 45 is provided with a pair of beveled surfaces 46 and 47 which correspond to the beveled surfaces of the slide notch 35.

Figure 9:
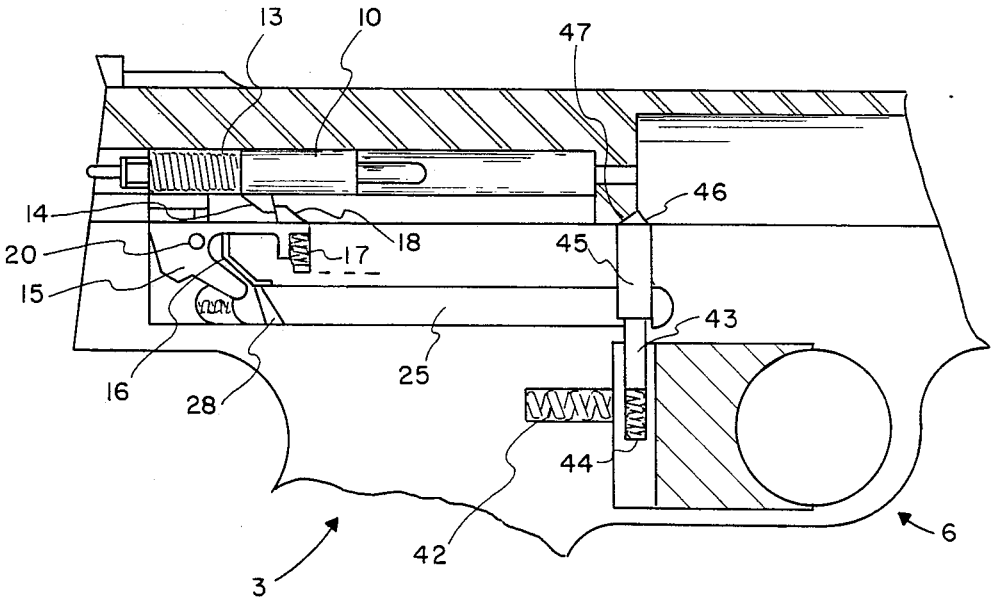
FIGS. 9–13 are partial cutaway views of a firearm of FIG. 1 showing the relative position of the moving parts during a complete discharge cycle.

Referring to FIG. 9, showing the firearm 1 in its cocked position, the firearm 1 is initially cocked by drawing the slide 2 rearwardly relative to the handle 3. As the slide 2 is drawn rearwardly relative to the handle 3, the slide 2 engages the striker assembly 10, moving the striker assembly 10 rearwardly. At this time, the sear 15 is in its cocked position with the free end of the spring 16 resting on the surface 29 of the member 28 of the actuating member 25. As the slide 2 is released to return to the position shown in FIG. 1, the tooth 14 of the striker 10 engages the ratchet 18 of the sear 15, holding the striker 10 in its cocked position against the force of the spring 13. When the slide 2 is returned fully to its predischarge position as shown in FIG. 1, the spring 44 pushing upwardly on the pin 43 and pin 45 in the trigger assembly 6, causes the beveled surfaces 46 and 47 to enter the notch 35 in the slide 2. As the surfaces 46 and 47 enter the notch 35 of the slide 2, an interior portion of the upper end of the pin 43 engages the notch 27 in the actuating member 25, thereby releasably coupling the trigger member 40 to the actuating member 25. At this point in the operation of the firearm 1, the firearm is fully cocked and ready to be fired.

Figure 10:
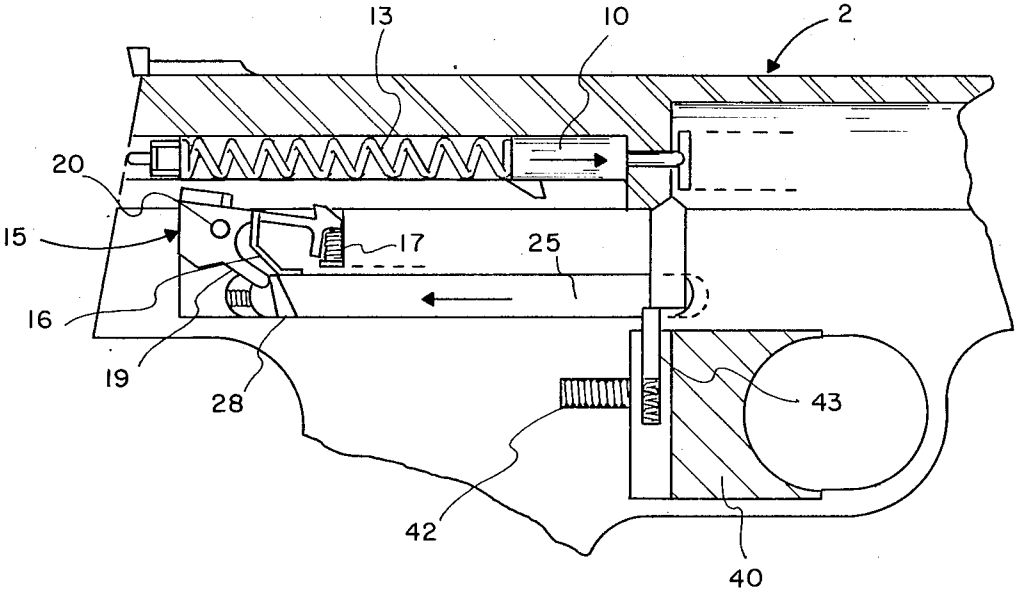

Referring to FIG. 10, showing the firearm 1 as it is fired, as the trigger 40 is pulled against the trigger spring 42, the pin 43 in the notch 27 moves the sear actuating member 25 rearwardly as shown by the arrows. As the sear actuating member 25 is moved rearwardly, the primary sear spring 16 slides off the surface 29 of the protrusion 28 of the actuating member 25, reducing the spring force holding the sear 15 in its cocked position. Upon a further movement of the sear actuating member 25, the sear arm 19 engages the surface 30 of the protrusion 28 of the sear actuating member 25, causing the sear to pivot about the axis of its pivot pin 20 against the force of the secondary sear spring 17. As the sear 15 is thus pivoted, the striker 10 is disengaged from the sear 15 and caused to move forwardly by the sear spring 13 until it strikes the primer of a bullet in the barrel 7.

Figure 12:
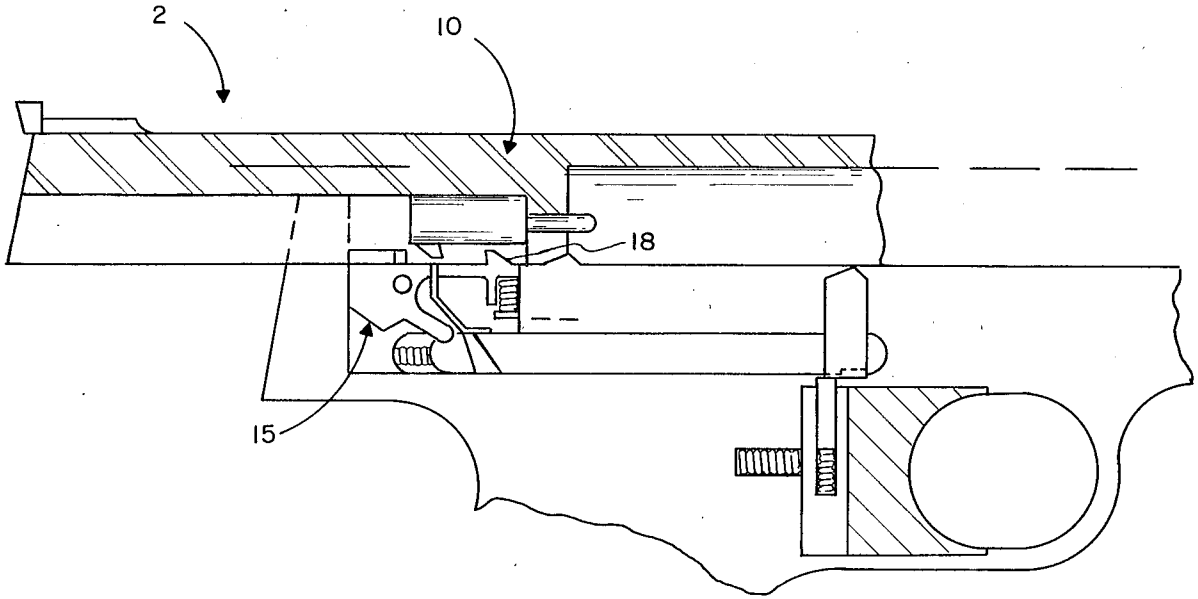

Referring to FIGS. 11 and 12, showing a partial and completed recoil of the slide 2, as the bullet in the barrel 7 is discharged from the barrel 7, the slide 2 recoils. As the slide 2 recoils and is displaced relative to the pin 45 in the trigger assembly 6, the pin 45 is forced out of the beveled notch 35 in the slide 2 and downwardly against the upper surface of the pin 43 and out of the notch 27. As the pin 43 is forced downwardly and out of the notch 27, the sear actuating member 25 is freed to be moved forwardly by the spring 31, as shown by the arrow. As the sear actuating member 25 is moved forwardly, the primary spring member 16 in the sear assembly 15 is engaged by the protrusion 28 extending from the sear actuating member 25, causing the sear 15 to be rotated to its cocked position. At the same time, the slide 2 carries the striker 10 beyond the ratchet 18 of the sear 15, as shown in FIG. 12.

Figure 13:
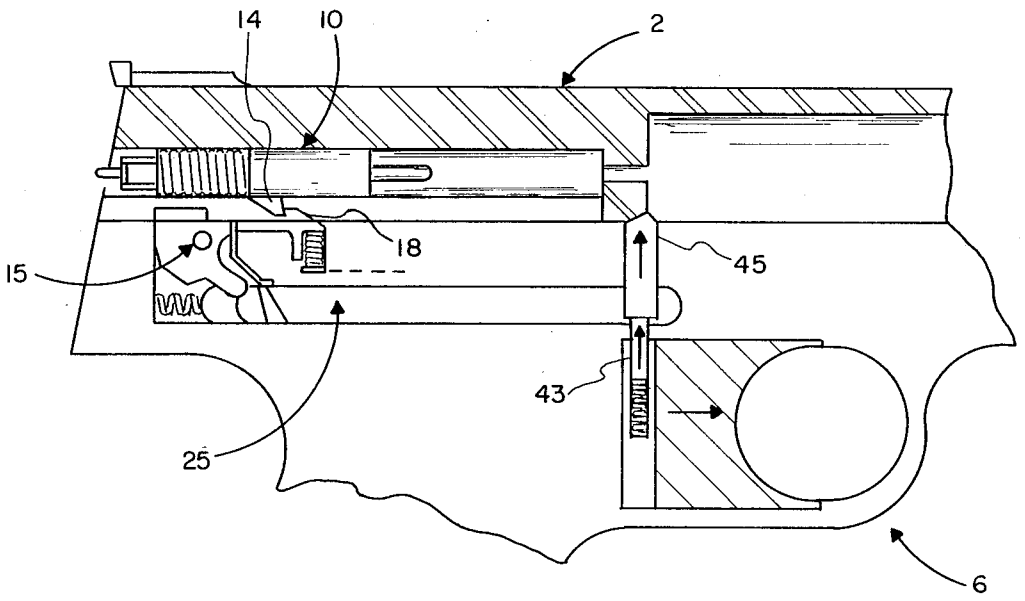

Referring to FIG. 13, showing the re-cocked position of the firearm 1, as the slide 2 returns to its predischarge position, the tooth 14 on the striker 10 is engaged by the ratchet 18 on the sear 15 for holding the striker 10 in its cocked position. When the slide 2 reaches its predischarge position, the pin 45 of the trigger assembly 6 enters the beveled notch 35 of the slide 2, removing the downward pressure on the pin 43. As soon as the trigger member 40 is released and allowed to moved forwardly as shown by the arrow, the pin 43 enters the notch 27 of the actuating member 25. At this point, the firearm is in a condition to be discharged once again.

In practice, the spring constant of the primary spring 16 of the sear assembly 15 is chosen to insure that the sear 15 will engage the striker 10 after each discharge of the firearm so as to prevent unintentional automatic discharge of the firearm. At the same time, the disengagement of the spring 16 from the sear actuating member 25 almost immediately after the trigger member 40 is first pulled, significantly reduces the amount of pressure necessary to discharge the firearm to that force necessary to overcome the spring constant of the much lighter secondary spring 17 in the sear assembly 15, thereby enhancing the accuracy of an operator of the firearm.

A further feature of a firearm according to the present invention is that the sear assembly 15 comprises a center of balance and is pivotally mounted in the firearm for rotation about its center of balance. As thus mounted, the sear will not move and, consequently, the firearm will not unintentionally discharge even when it is dropped or struck by a sharp blow.

While a preferred embodiment of the present invention is described above, it is contemplated that various modifications may be made thereto without departing from the spirit and scope of the present invention. Therefore, it is intended that the embodiment described be considered only as illustrative of the invention and that the actual scope thereof be determined by reference to the claims hereinafter provided.

What is claimed is:

1. A singulating apparatus for a semiautomatic firearm having a movable slide and a striker which is movably mounted in said slide and movable by said slide from a firing position to a cocked position against a spring force in response to a discharge of a bullet therefrom comprising:

a sear which is movable between a firing position and a cocked position having means for engaging and releasably holding said striker in its cocked position against said spring force when said sear is in its cocked position;

a sear actuating means which is movable between a cocked position and a firing position for disengaging said striker and said sear; and means for resiliently holding said sear in its cocked position with a predetermined force when said sear actuating means is in its cocked position and for removing said force from said sear when said sear actuating means is moved from its cocked position.

2. An apparatus according to claim 1 wherein said sear comprises a center of balance and is pivotally mounted in said firearm for pivotal movement about said center of balance between its cocked and firing positions.

3. An apparatus according to claim 1 wherein said sear comprises an arm member which extends therefrom and said sear actuating means comprises means for engaging said arm member when said sear actuating means is moved from its cocked position to its firing position.

4. An apparatus according to claim 3 wherein said sear actuating means comprises a longitudinal axis and said arm member engaging means comprises a projection having a surface which extends in a plane perpendicular to said longitudinal axis for engaging said arm member.

5. An apparatus according to claim 4 wherein said projection is located interior of an end of said sear actuating means, said end of said sear actuating means is located for movement along one side of said arm member when said sear actuating means is moved from its cocked position to its firing position and said plane of said surface is inclined relative to said longitudinal axis.

6. An apparatus according to claim 1 wherein said sear actuating means comprises:

a linkage which is movable between a cocked position and a firing position and which has a surface for engaging and moving said sear when said linkage is moved from its cocked position to its firing position;

a trigger member which is movable between a cocked position and a firing position; and means for releasably coupling said trigger member and said linkage.

7. An apparatus according to claim 6 wherein said coupling means comprises a spring biased movable connecting member.

8. An apparatus according to claim 6 wherein said coupling means comprises:

a connecting member movably mounted in said trigger member; and a spring member for moving an end of said connecting member into a notch located in said linkage when said linkage and said trigger member are located in their cocked positions.

9. An apparatus according to claim 1 wherein said movable slide recoils and returns to a predischarge position in response to a discharge of a bullet therefrom and said sear actuating means comprises:

a linkage which is movable between a cocked position and a firing position and which has a surface for engaging and moving said sear when said linkage is moved from its cocked position to its firing position;

a trigger member which is movable between a cocked position and a firing position;

means for releasably engaging said trigger member and said linkage when said linkage and said trigger member are in their cocked position and said slide is in its predischarge position; and means for disengaging said trigger member and said linkage when said slide is moved from its predischarge position.

10. An apparatus according to claim 1 wherein said linkage comprises a linkage trigger notch, said slide comprises a slide trigger notch and said engaging and disengaging means comprise a first movable member located in said trigger member, means for moving said first movable member into said linkage trigger notch and a second movable member having an end thereof adapted for movement out of and into said slide trigger notch for moving said first movable member out of and into said linkage trigger notch as said slide recoils and returns to its predischarge position.

11. An apparatus according to claim 1 wherein said sear holding and force removing means comprises:

a spring member which extends from said sear in a cantilevered fashion having a free end, and means located on said sear actuating means which engages said free end of said spring member when said sear actuating means is in its cocked position and is disengaged from said free end of said spring member when said sear actuating means is moved from its cocked position.

12. An apparatus according to claim 11 wherein said spring engaging means comprises a projection which extends from said sear actuating means.

* * * * *